US006237493B1

(12) United States Patent
Suda et al.

(10) Patent No.: US 6,237,493 B1
(45) Date of Patent: May 29, 2001

(54) PRINTER AND RESTORATION METHOD FOR PRINTING PLATES

(75) Inventors: Yasuharu Suda; Shoichi Aoki, both of Nishi-ku (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/398,822

(22) Filed: Sep. 20, 1999

(30) Foreign Application Priority Data

Sep. 21, 1998 (JP) ..... 10-266384

(51) Int. Cl.[7] ..... B41N 3/08; B41N 3/00

(52) U.S. Cl. ..... 101/465; 101/463.1; 101/467; 430/19; 430/302

(58) Field of Search ..... 430/19, 302; 101/463.1, 101/467, 465, 395, 470

(56) References Cited

U.S. PATENT DOCUMENTS

| | | | | |
|---|---|---|---|---|
| 4,204,865 | * | 5/1980 | Kuehnle et al. | 430/30 |
| 4,259,905 | * | 4/1981 | Abiko et al. | 101/467 |
| 5,333,548 | * | 8/1994 | Fadner | 101/467 |
| 5,607,534 | * | 3/1997 | Kawanishi et al. | 156/234 |
| 6,048,654 | * | 4/2000 | Nakayama et al. | 430/19 |

FOREIGN PATENT DOCUMENTS

| | | |
|---|---|---|
| 59-44225 | 10/1984 | (JP) . |
| 2855022 | 11/1988 | (JP) . |
| 2-175250 | 7/1990 | (JP) . |
| 6-210977 * | 8/1994 | (JP) . |

* cited by examiner

*Primary Examiner*—Daniel J. Colilla
(74) *Attorney, Agent, or Firm*—Oblon, Spivak, McClelland, Maier & Neustadt, P.C.

(57) ABSTRACT

A printer and a restoration method for a printing plate which can be reused, while coping with digitization of printing processes is provided. On a substrate serving as a hydrophilic surface mounted beforehand onto a plate cylinder, a toner image portion formed on the surface of a photosensitive material is adhered and fixed directly or via an intermediate body to thereby form an image area. In thus way, the substrate is divided into a hydrophobic image area having at least a 50° or higher contact angle with water and a non-image area having an ink repulsion property, to thereby form a printing plate. After completion of printing, the ink and wetting solution adhered to the surface of the printing plate are cleaned by a cleaning apparatus, and image area on the surface of the printing plate is then removed by a chemical treatment solution supply roller, to thereby restore the printing plate to the initial condition so that this can be reused.

7 Claims, 2 Drawing Sheets

PRINTER AND RESTORATION METHOD FOR PRINTING PLATES

BACKGROUND OF THE INVENTION

1. Field of the Invention

The present invention relates to a printer and a restoration method for a printing plate, utilized mainly in electrophotographic processes using a liquid toner.

2. Description of the Related Art

As a general printing technique, recently digitization of printing processes is progressing. There is thus a challenge to convert an image or the like into digital data by preparing an image or a script with a personal computer or reading an image by a scanner or the like, and to directly utilize the digital data for preparation of a plate used for printing. In this way, a labor-saving effect can be attained in the overall printing processes as well as making highly detailed printing possible.

As a conventional plate, a so-called PS plate is generally known. This plate has a hydrophilic non-image area made of an anodized aluminum oxide, and a hydrophobic image area formed by curing a photosensitive resin on a surface of the non-image area. Printing is performed by transferring ink attached to the hydrophobic image area onto a paper surface. This PS plate is not one which can cope with above mentioned digitization of the printing processes.

On the other hand, in addition to the above described PS plate there has been proposed another method which can cope with digitization of printing processes and make preparation of the plate easy. For example, there is known a method in which a picture line is registered by a laser beam on a PET film on which a laser absorbing layer such as carbon black has been applied and a silicon resin layer has further been applied thereon, to thereby heat the laser absorbing layer so that the silicon resin layer is burnt by the heat to thereby prepare a plate. Moreover, there is known another method in which an lipophilic laser absorbing layer is applied onto an aluminum plate, and a hydrophilic layer is applied thereon, which is then burnt by a laser beam in the same manner as described above to thereby prepare a plate.

With the related art however, there are problems as described below. First, with the PS plate, significant time and cost are required in the preparation thereof so that particularly with the printing of a small number of copies, this causes a cost increase in printing. Moreover, when the printing of one pattern has been completed and the next printing is to be performed, the plate must be replaced, and the formerly used plate discarded. Furthermore, as described above, the PS plate is not one which can cope with the digitization of printing processes. That is to say, with the PS plate, a plate cannot be directly prepared from digital data, making it impossible to realize digitization of printing processes for attaining laborsaving and highly detailed printing.

Moreover, preparation of a plate which can cope with the above described digitization, that is one using a PET film or an aluminum plate can certainly be prepared directly from digital data, but once the printing of one pattern is completed, the plate must be replaced by a new plate for printing to be possible. That means there is no difference to the above described PS plate, in terms of the circumstances that the plate once used must be discarded. That is to say, the printing cost relating to replacement of the plate increases. Furthermore, from the standpoint of global environmental protection which has recently been advocated, discarding a plate used only once is undesirable.

With an electronic editing system using digital data, then as a method for preparing a printing plate directly from the output of a terminal plotter, there is known a method in which after a toner image has been formed on a photosensitive material surface in an electrophotographic process, a non-image area is made hydrophilic using a desensitizer to thereby prepare a printing plate. Moreover, there is another method in which after a toner image has been formed, a photoconductive layer in a non-image area is removed to thereby prepare a printing plate. However, with these plate making methods using the electrophotographic process, restoration of the printing plate for repeated use as with the abovementioned PS plate, the PET film plate, the aluminum plate and the like, has not at all been considered, and a plate used once is discarded.

SUMMARY OF THE INVENTION

The present invention has been completed under this background, with the object of providing a printer and a restoration method for a printing plate which can be reused, while coping with digitization of printing processes.

The present invention utilizes the following means for solving the above described problems.

That is to say, a restoration method for a printing plate according to a first aspect of the invention is characterized in that with a printing plate where an image area is formed on a substrate serving as a hydrophilic surface having an ink repulsion property at the time of printing, by adhering and fixing directly or via an intermediate body a toner image portion formed on a photosensitive material surface, after the printing plate has been subjected to actual printing, the printing plate is restored by removing the image area on the printing plate surface through chemical treatment and/or physical treatment.

According to this method, a printing plate having an image area and a non-image area can be prepared by adhering and fixing a toner image portion formed on a photosensitive material surface on a substrate serving as a hydrophilic surface. At this time, drawing an image on the photosensitive material surface and forming a toner image portion based on the drawing can be executed by a method including exposure by means of a semiconductor laser or the like. Hence, it can be said that the present invention copes with the digitization of printing processes. Moreover, by subjecting the printing plate after completion of printing, to a chemical treatment and/or physical treatment, reuse of the printing plate becomes possible. That is to say, it becomes possible to reform the toner image portion based on a new image. The above described chemical treatment refers to a treatment in which for example a chemical substance or solution which swells and/or dissolves a toner resin for forming the toner image portion, is applied to the printing plate. Moreover, the physical treatment literally refers to a treatment for physically scraping off the toner image portion adhered and fixed onto the substrate.

A restoration method for a printing plate according to a second aspect of the invention is characterized in that the toner image portion formed on the photosensitive material surface is heated on the substrate and/or on the surface of the intermediate body to thereby adhere and fix the toner image portion onto the substrate. Moreover, the toner image portion formed on the substrate after been adhered and fixed is characterized by a third aspect of the invention in that the adhesive force has a surface peeling capability of 3.0 gf or higher.

Accordingly, adhesion and fixation of the toner image portion onto the substrate can be reliably performed, enabling an improvement in printing endurance of the printing plate. Moreover, by stipulating that the adhesive force has "a surface peeling capability of 30 gf or higher", the above described printing endurance is reliably ensured. Frankly speaking, with this restoration method for a printing plate, it is possible to avoid a situation where the toner is peeled from the substrate during printing.

With a restoration method for a printing plate according to a fourth aspect of the invention, the toner image portion is formed from a liquid toner having at least a 50° or higher contact angle with water.

This toner image portion can demonstrate a sufficient capability as an image area of the printing plate. That is to say, with the toner image portion, ink receptivity is reliably ensured, and during printing, unevenness on the printing face or a deficiency in optical density of printed matter does not arise.

Moreover, with a restoration method for a printing plate according to a fifth aspect of the invention, the restoration method for a printing plate according to any one of the first through fourth aspects is performed on a printer.

With the present invention, specifically this has the meaning that the drawing of an image on a photosensitive material surface, the formation of a toner image portion on the substrate surface, the cleaning thereof and the restoration process by means of a chemical treatment and/or physical treatment are carried out on a printer. In this way, continuous printing operation can be performed. This is because the normally presumed interruption of operations is not required in the process relating to restoration of the printing plate.

Furthermore, a printer according to another aspect of the invention is characterized by comprising at least as constituents, a photosensitive material on which a toner image portion is formed by a drawing apparatus including an exposure light source, a plate cylinder (drum) on which can be mounted a substrate to which the toner image portion is transferred by means of contact with the photosensitive material to form an image area, and a device for supplying a chemical treatment solution onto the substrate for removing the image area.

This printer can be said to be a printer having a construction suitable for digitization of printing processes and for restoration of a printing plate.

DESCRIPTION OF THE PREFERRED EMBODIMENT

Figure 1:
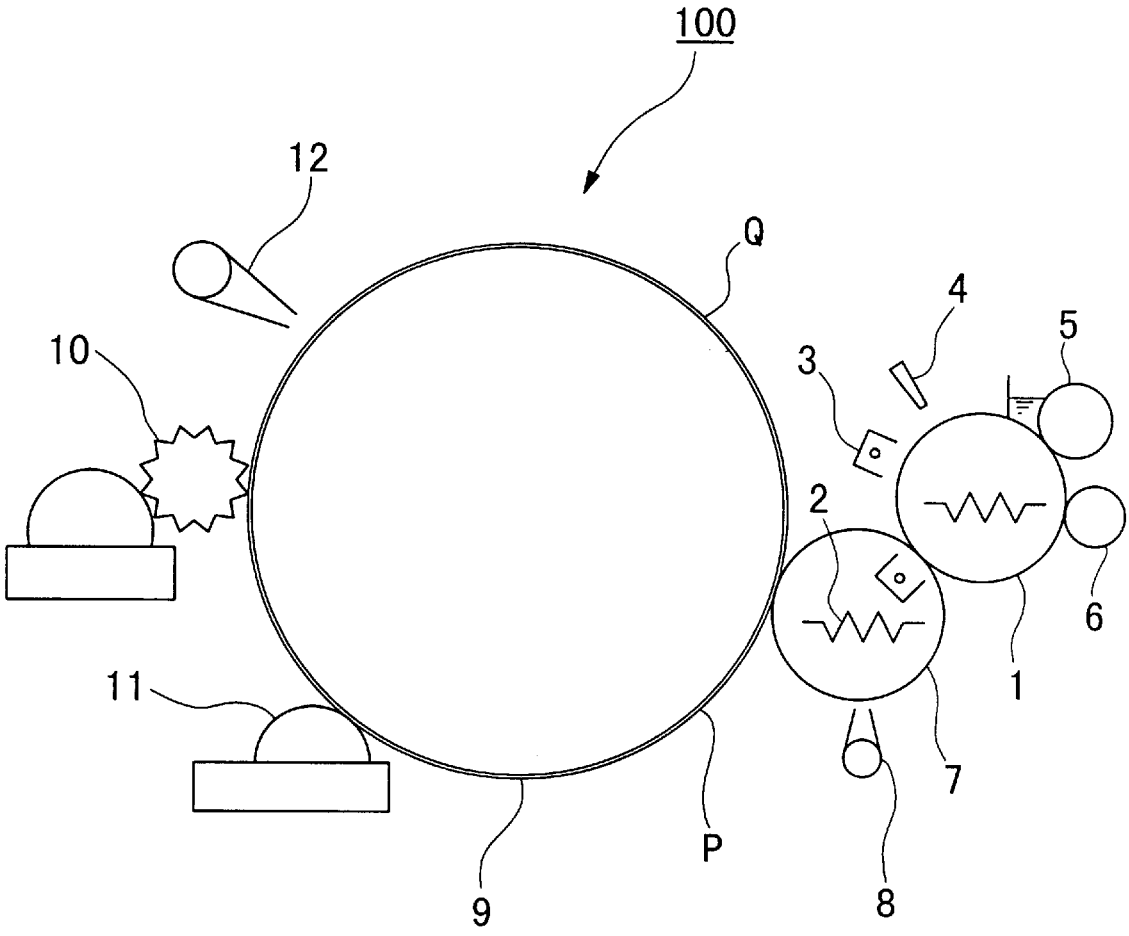
FIG. 1 is a diagram showing a construction of a printing unit including an electrophotographic processing section.

Next is a description of an embodiment of the present invention, with reference to accompanying drawings. FIG. 1 shows the construction of a printing unit (printer) 100 equipped with an electrophotographic processing section suitable for realizing a restoration method for a printing plate according to the present invention. In addition, FIG. 1 shows the construction of an apparatus relating to a transfer operation for a toner image.

First in FIG. 1, it will be briefly described how image transfer to a printing plate P installed on a plate cylinder (drum) 9 is performed. A substrate Q having been subjected to a hydrophilizing treatment so as to have an ink repulsion property at the time of printing is mounted onto the plate cylinder 9, and an image is drawn by a semiconductor laser drawing apparatus (drawing apparatus) 4 on a photosensitive material 1, which is developed by a toner developing apparatus 5 to form a toner image portion. The toner image portion is transferred to an intermediate body 7, and further adhered and fixed onto the substrate Q to form an image area, to thereby prepare a printing plate P.

The printing plate P prepared in the above described manner is subjected to a restoration process, after having been subjected to an actual printing process. The restoration process is a process for cleaning the surface of the printing plate P by a cleaning apparatus 10 to give a clean condition, and then removing the image area by means of a chemical treatment and/or physical treatment, involving pressing and rotating a chemical treatment solution supply roller (device for supplying chemical treatment solution) 11 against the printing plate P. In this way it becomes possible to again perform adhesion and fixation of the toner image portion from the above described photosensitive material 1 onto the printing plate P. Of course here the toner image portion can be new and different from the previous image, that is, based on a new image. In short, the printing plate P in this embodiment is reusable through the preparation process and the restoration process.

Below is a description of respective constituents of the printing unit 100 having the above described construction and operation. First, with the substrate Q, for example an anodized aluminum oxide plate is prepared. Therefore, in this case, "having a hydrophilic surface" refers to a surface of a so-called PS plate subjected to a graining treatment.

As the photosensitive material 1, there can be used any conventionally known materials including inorganic photosensitive materials such as amorphous silicon, selenium and the like, and organic photosensitive materials. In the case of inorganic photosensitive materials, it is preferable to perform transfer of the toner image portion from the photosensitive material 1 to the substrate Q via the intermediate body 7, to suppress the occurrence of damage to the surface of the photosensitive material 1 due to direct contact with the substrate Q of the anodized aluminum oxide plate or the like.

As the intermediate body 7, any of the intermediate bodies 7 normally used in the electrophotographic process can be used. Materials for the intermediate body 7 include silicon rubber, fluorine rubber, chlorosulfonated polyethylene rubber, chloroprene rubber and the like. However, it is a matter of course that the present invention is not limited to these materials, and a material may be optionally selected, considering printing endurance and the like. The specific form of the intermediate body 7 may be suitably selected, depending on whether the process construction involves a belt arrangement or a cylinder arrangement or the like.

Adhesion and fixation of the toner image portion formed on the photosensitive material 1 onto the substrate Q is performed while applying heat thereto. This heating operation may be performed on the intermediate body 7, when used as described above, or after being transferred onto the substrate Q, or may be performed on both the substrate Q and the intermediate body 7. As the heating method, any method including non-contact methods such as infrared ray irradiation or hot-air blowing, contact heating methods by means of a heating roller or the like, or conductive heating from the inside of the intermediate body 7 or the inside of the substrate Q may be used. Of course these methods may be used in combination. In FIG. 1, it is possible to perform heating respectively by means of, a heating device 2 provided in the inside of the intermediate body 7, a blower device 8 facing the surface of the intermediate body 7, and a blower device 12 facing the plate cylinder 9. With the operation and method relating to the heating, the temperature is preferably set to be 10 to 100° C. higher than the softening point of the thermoplastic resin constituting the liquid toner.

From the standpoint of printing endurance of the printing plate, the toner image portion adhered/fixed onto the substrate Q should have a stickiness and adhesivness to the substrate Q, and the adhesive force should be at least 30 gf. If the adhesive force is less than 30 gf, the printing endurance of the printing plate decreases, and as a result, the possibility that the toner forming the image area may be peeled from the substrate Q increases. The adhesive force herein is evaluated by means of the "Adhesive Tape/Adhesive Sheet Test Method" of JIS Z 0237-1980.

In addition, the toner image portion adhered/fixed onto the substrate Q surface should be hydrophobic so as to have the ink receptivity for the image area of the printing plate. As the measure of the hydrophobicity, if a contact angle with water is used, the contact angle with water is preferably at least 50° or higher. More preferably, an 80° or higher contact angle with water is desired. The reason is that if the contact angle with water is less than 50° or less than 80° which is the preferable condition, the ink receptivity is deteriorated, and unevenness on the printed face or a deficiency in optical density of the printed matter may arise.

The capability of the stickiness/adhesiveness and the hydrophobicity of the above described toner image portion depends largely upon the properties of the thermoplastic resin constituting the liquid toner. As a toner resin suitable for plate making according to the present invention, there can be mentioned for example, vinyl chloride resin, vinylidene chloride resin, vinyl acetate resin, polyvinyl acetal resin, styrene-type resin, methacrylic acid resin, polyethylene resin, polypropyrene resin, fluorine-type resin, polyamide-type resin, polyacetal resin, saturated polyester resin, ethylene-vinyl acetate copolymer, partially saponified ethylene-vinyl acetate copolymer, ethylene-(meta) acrylic acid copolymer, (meta) acrylate ester resin, styrene-(meta) acrylic acid copolymer, styrene-(meta) acrylate ester copolymer and the like. These can be used singly, or in combination of two or more.

With the above described restoration process for the printing plate P, what is cleaned by the cleaning apparatus 10 is the ink or wetting water adhered onto the plate surface. Moreover, the subsequent chemical treatment and/or physical treatment is performed specifically, by using a chemical substance or solution (hereinafter referred to as "chemical treatment solution") which swells and/or dissolves the above described toner resin, and applying the chemical treatment solution onto a plate face having the toner image portion, or immersing the plate face in the chemical treatment solution. Moreover, physical treatment literally means a treatment for physically revealing a new surface by scraping off the toner image portion on the plate face.

As the above described chemical treatment solution, there can be used organic acids such as dimethylsufoxide, adipic acid and the like; organic acid esters such as methyl adipate, dimethyl glutarate and dimethyl succinate; organic amines such as hexamethylene diamine and the like; ethers such as triethylene glycol dimethyl ether and the like; oleic acid type surfactants; aromatic organic solvents; paraffin hydrocarbons; and ketones, singly or in combination of two or more. Moreover, as described above, these may of course be used as a solution diluted by a dilution solvent.

Below is a description of a specific example confirmed by the present inventors, with regards to the preparation and restoration of a printing plate and the actual printing operation. With this example a printing plate was prepared by means of an electrophotographic process shown below, using a printing unit 100 equipped with the electrophotographic processing section as shown in FIG. 1.

First, after the surface temperature of the photosensitive material 1 made from amorphous silicon had been adjusted to be 40° C., the photosensitive material 1 surface was charged up to +500 V by a corona charging apparatus 3. Then, exposure was effected at a pitch of 10 $\mu$m as a beam spot of 15 $\mu$m, using light having a wavelength of 788 nm emitted from the semiconductor laser drawing apparatus 4. Development was then effected by electrodepositing a toner onto an exposure portion of the photosensitive material 1 with the toner developing apparatus 5. Then after excessive carrier liquid (product name: ISOBAR-L) had been removed with a squeezing apparatus 6, the photosensitive material 1 and the intermediate body 7 were brought into contact with each other, to thereby transfer the toner image portion onto the surface of the intermediate body 7 by means of electrostatic attraction. Subsequently, hot air at 120° C. was blown onto the toner image portion on the surface of the intermediate body 7 from the blower device 8 to evaporate and dry the carrier liquid, and at the same time, the toner resin was softened or melted. The intermediate body 7 was then brought into contact with the PS plate (substrate) Q which had been subjected to hydrophilizing processing and which was mounted on the plate cylinder 9, and pressed at a nip pressure of 4 kg/cm$^2$, to thereby transfer the whole toner image portion onto the PS plate. By the above, preparation of the printing plate P was completed.

Figure 2:
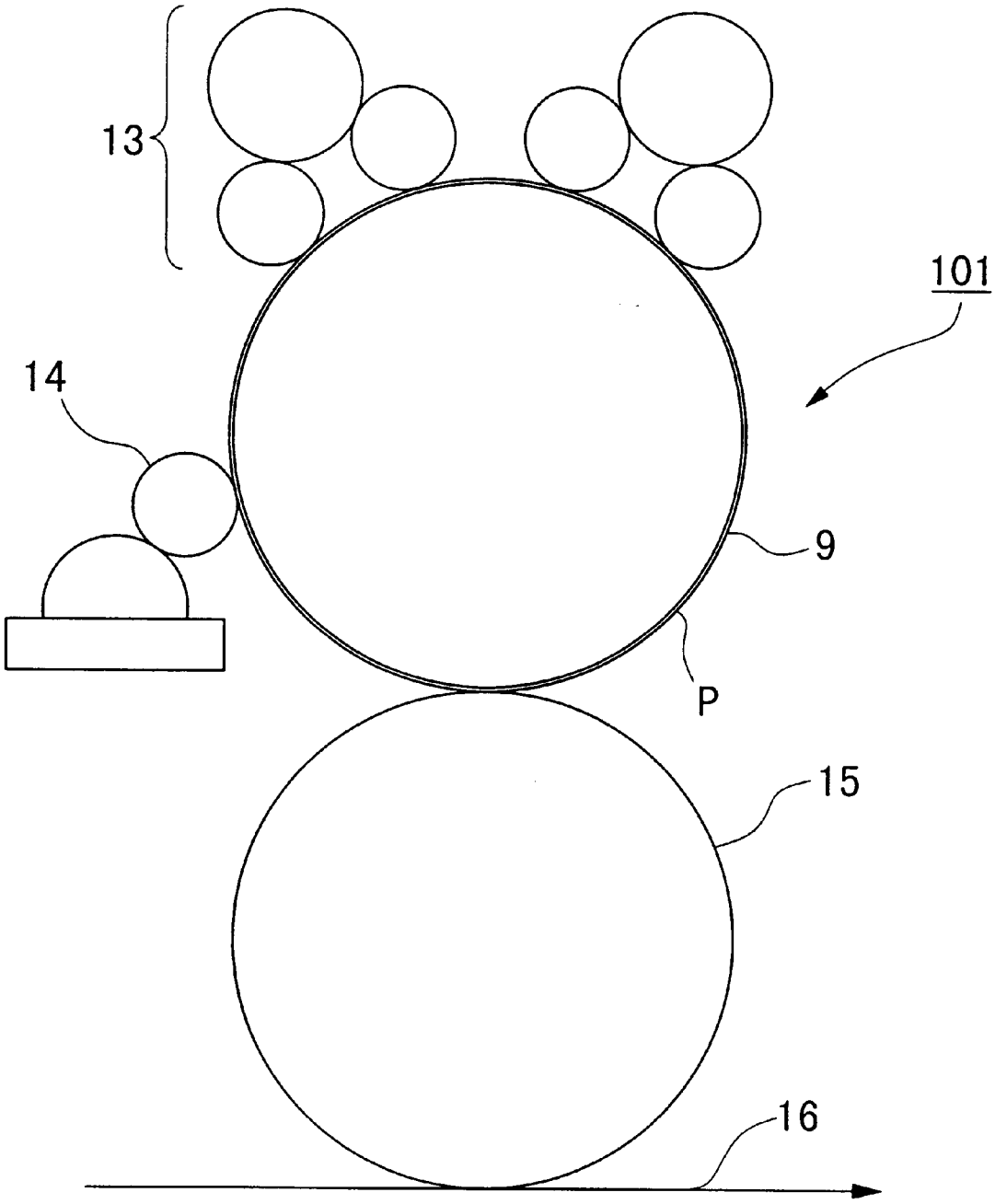
FIG. 2 is a diagram showing a construction of a printing unit used for an actual printing process.

Next, the electrophotographic processing section used for the preparation of the printing plate P was detached from the plate cylinder 9, and as shown in FIG. 2, a printing unit (printer) 101 comprising inking rollers 13, a wetting roller 14 and a blanket cylinder (drum) 15, in addition to the plate cylinder 9 was constructed. With this printing unit 101, printing was effected to a coated paper 16, using on the printing plate P an ink HYECOO B red produced by Toyo Ink and a wetting solution Resofellow 1% aqueous solution produced by Mitsubishi Jyukogyo, to thereby obtain more than 10,000 sheets of printed matter having a clear image without the occurrence of scumming.

After completion of printing, the printing unit 101 such as the inking rollers 13, the wetting roller 14 and the blanket cylinder 15 were detached from the plate cylinder 9, to again make up a printing unit 100 comprising the electrophotographic processing section, as shown in FIG. 1. After the ink and wetting solution adhered to the surface of the printing plate P had been wiped off by the cleaning apparatus 10, the toner image portion on the plate surface was subsequently wiped off (physical treatment) by the cleaning apparatus 10, while supplying a chemical treatment solution (chemical treatment) onto the plate face with a treatment solution supply roller 11. Subsequently, hot air was blown onto the plate surface by the blower device 12 to dry the plate surface, to thereby restore the PS plate Q to the condition before plate making. That is to say, the PS plate Q was ready for new image registration, through the process for preparing the plate described above.

By performing the restoration method for a printing plate of this embodiment as described above, reuse of the printing plate becomes possible, so that the quantity of plates discarded after use can be markedly reduced. The cost relating to the plate can thus be greatly reduced. Moreover, image registration on the plate can be directly performed by exposure from digital data relating to the image. Hence the method can cope with the digitization of printing processes, enabling a significant reduction in time and cost.

Preparation and restoration of the printing plate can be performed on the printing units 100 and 101, as described above. Hence speeding up of the printing operation can be realized. With the above embodiment, image registration is also performed on the printing unit 100, thereby enabling more rapid operation.

The "printer" herein refers to one including both constructions of the above described printing units 100 and 101 in this embodiment. That is to say, both units are shown as separate constructions in this embodiment, but this is not essential. For example, if conditions such as installation restriction and the like are cleared, the above described printing units 100 and 101 may be integrally constructed without any problem.

Moreover, with the above embodiment, when the toner image portion is transferred to the substrate Q, the heating operation was effected. However, with the present invention, this operation does not always need to be done. That is to say, printing without the heating operation is considered to be within the general concept of the technical ideas of the present invention. Moreover, in connection with this, it has been noted above that the temperature relating to the heating operation is "set to be 10 to 100° C. higher than the softening point of the thermoplastic resin constituting the liquid toner". However the present invention is not limited to this heating temperature.

As described above, the restoration method for a printing plate according to the first aspect of the invention is a method in which an image area is formed on a substrate serving as a hydrophilic surface by adhering and fixing directly or via an intermediate body a toner image portion formed on a photosensitive material surface. Therefore, a printing plate having the image area and non-image area is prepared. Moreover, image drawing on the photosensitive material surface serving as a base for forming a toner image portion can be executed by exposure with a semiconductor laser or the like. Therefore, it can be said that the present invention can cope with the digitization of printing processes, enabling a substantial reduction in printing time and cost. Furthermore, after completion of printing, by removing the image area on the printing plate by a chemical treatment and/or physical treatment, the printing plate can be reused. Hence, it is not necessary, as with the conventional case, to discard the printing plate after completion of printing, thus enabling a reduction in cost.

Moreover, with the restoration method for a printing plate according to the second aspect of the invention, the adhesion and fixation of the toner image portion to the substrate is executed by heating. Hence adhesion and fixation is accomplished reliably. That is to say, with this restoration method, it is possible to avoid the situation where the toner is peeled from the substrate during printing. Hence high quality printing can always be performed.

With the restoration method for a printing plate according to the third aspect of the invention, the adhesive force of the toner image portion adhered and fixed onto the substrate has a surface peeling capability of 30 gf or higher. Hence the effect described with regard to the third aspect can be further ensured. That is to say, high quality printing can be performed more reliably.

With the restoration method for a printing plate according to the fourth aspect of the invention, the toner image portion is formed from a liquid toner having at least 50° or higher contact angle with water. Hence the image area formed based on the toner image portion can have sufficient ink receptivity. Therefore, high quality printing can be performed without the occurrence of unevenness on the printing face or a deficiency in optical density of printed matter during printing, and high grade printed matter can be provided.

With the restoration method for a printing plate according to the fifth aspect of the invention, the restoration method for a printing plate according to any one of the first through fourth aspects is performed on a printer. Hence the normally presumed interruption of operations is not required, enabling the overall printing processes to be performed rapidly. Moreover, with the present invention, the various merits described above related to reuse of the printing plate can be obtained at the same time.

Furthermore, with the printer according to the other aspect of the invention, since this is equipped with a drawing apparatus including an exposure light source, and a device for supplying onto a substrate, a chemical treatment solution for removing an image area formed on the substrate, then it can be said that this is a printer having a construction suitable for the digitization of printing processes and the restoration of the printing plate.

What is claimed is:

1. A restoration method for a printing plate comprising:

providing a substrate comprising a hydrophilic surface having an ink repulsion property;

adhering and fixing a toner image portion formed on a photosensitive material surface directly or via an intermediate body on the hydrophilic surface of the substrate to form a printing plate; and after printing with said printing plate, restoring said printing plate by removing said toner image portion through chemical treatment and/or physical treatment in order to reuse the printing plate to print other images.

2. A restoration method for a printing plate according to claim 1, further comprising:

heating the toner image portion on said substrate and/or the surface of said intermediate body to thereby adhere and fix the toner image portion onto said substrate.

3. A restoration method for a printing plate according to claim 1, wherein the toner image portion is adhered and fixed to the hydrophilic surface of the substrate such that force to peel said toner image portion from the substrate is at least 30 gf.

4. A restoration method for a printing plate according to claim 1, wherein the toner image portion is formed from a liquid toner having a contact angle of at least 50° with respect to water.

5. A restoration method for a printing plate according to claim 1, wherein the restoration method is performed in a printer.

6. A restoration method for a printing plate according to claim 1, wherein the chemical treatment comprising:

applying at least one of organic acids, organic acid esters, organic amines, ethers, oleic acid surfactants, aromatic organic solvents, paraffin hydrocarbons and ketones to the toner image portion on the printing plate surface.

7. A printer comprising:

a photosensitive material;

a drawing apparatus having an exposure light source and configured to form a toner image portion on the photosensitive material;

a substrate which comprises a hydrophilic surface having an ink repulsion property and an adhered and fixed toner image portion said toner image portion being applied to the substrate directly or via an intermediate body to form a printing plate;

a plate cylinder around which the substrate is mounted; and a restoration device configured to restore said printing plate by removing said toner image portion through chemical treatment and/or physical treatment in order to reuse the printing plate to print other images after printing with said printing plate.

* * * * *